US010149030B2

(12) United States Patent
Akino

(10) Patent No.: US 10,149,030 B2
(45) Date of Patent: Dec. 4, 2018

(54) MICROPHONE

(71) Applicant: Hiroshi Akino, Tokyo (JP)

(72) Inventor: Hiroshi Akino, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 251 days.

(21) Appl. No.: 14/924,015

(22) Filed: Oct. 27, 2015

(65) Prior Publication Data

US 2016/0182984 A1 Jun. 23, 2016

(30) Foreign Application Priority Data

Dec. 19, 2014 (JP) ..... 2014-257178

(51) Int. Cl.

| | |
|---|---|
| ***H04R 25/00*** | (2006.01) |
| ***H04R 1/02*** | (2006.01) |
| ***H04R 19/04*** | (2006.01) |
| ***H04R 19/01*** | (2006.01) |
| *H04R 1/04* | (2006.01) |

(52) U.S. Cl.
CPC ..... *H04R 1/026* (2013.01); *H04R 19/016* (2013.01); *H04R 19/04* (2013.01); *H04R 1/04* (2013.01)

(58) Field of Classification Search
CPC ..... H04R 1/026; H04R 19/016; H04R 19/04; H04R 1/04
USPC ..... 381/355, 361, 369
See application file for complete search history.

(56) References Cited

U.S. PATENT DOCUMENTS

| | | | | |
|---|---|---|---|---|
| 6,549,632 | B1 * | 4/2003 | Akino | H04R 9/08 381/174 |
| 6,594,369 | B1 * | 7/2003 | Une | H04R 19/016 381/174 |
| 7,801,321 | B2 | 9/2010 | Akino | |
| 2012/0212925 | A1 * | 8/2012 | Zoellin | H04R 19/005 361/807 |
| 2012/0237071 | A1 * | 9/2012 | Phillips | H04R 1/086 381/355 |
| 2014/0133679 | A1 * | 5/2014 | Gorelik | H04R 31/006 381/174 |
| 2014/0233782 | A1 * | 8/2014 | Bolognia | H04R 1/04 381/360 |

FOREIGN PATENT DOCUMENTS

| | | |
|---|---|---|
| JP | 4683996 | 5/2011 |

* cited by examiner

*Primary Examiner* — Phylesha Dabney
(74) *Attorney, Agent, or Firm* — W&C IP

(57) ABSTRACT

The present invention provides a microphone including: a microphone unit including a vibration plate that vibrates in response to sound; a unit board disposed rearward of the vibration plate; a first ground pattern disposed on the rear surface of the unit board; a unit casing accommodating the microphone unit and the unit board; a contact region of the unit casing, the contact region being in contact with the first ground pattern; a main board having a side face having a second ground pattern, the second ground pattern being in contact with the contact region; and an adhesive joining the side face of the main board to the microphone unit.

16 Claims, 9 Drawing Sheets

MICROPHONE

BACKGROUND OF THE INVENTION

Technical Field

The present invention relates to a microphone.

Background Art

A microphone 100 shown in FIGS. 6 and 7 is a compact condenser microphone, which is used in a meeting for example. In order to reduce the size of a housing 140 of the microphone 100, a unidirectional electret condenser microphone unit is used as a microphone unit 110.

As shown in FIG. 8, the microphone unit 110 includes a vibration plate 111 that vibrates in response to sound, and a circuit board (referred to as a unit board 112 hereinafter) having electronic components thereon. The microphone unit 110 also includes a unit casing 113 accommodating the vibration plate 111 and the unit board 112.

In the microphone unit 110, the vibration plate 111 is designed to have low tension to collect low-pitched sound. If the microphone unit 110 is subjected to high stress, the stress transmitted from the unit casing 113 deforms the vibration plate 111. The deformed vibration plate 111 increases its tension and precludes collection of low-pitched sound. In contrast, if the stress on the microphone unit 110 is low, the displacement of the vibration plate 111 and the unit board 112 occurs in the unit casing 113 due to the vibration, resulting in generation of noise.

In order to reduce the size of the housing 140 accommodating the microphone unit 110, the microphone 100 includes an electronic circuit board (referred to as a main board 120 hereinafter) disposed rearward of the vibration plate 111. The main board 120 has a side face having a ground pattern 1220. The ground pattern 1220 is in contact with a ground pattern 1210 of the unit board 112 exposed at the rear end of the unit casing 113 such that the unit casing 113 is grounded.

As shown in FIGS. 8 and 9, the unit board 112 exposed at the rear end of the unit casing 113 is connected to the main board 120 in the housing of the microphone 100. In this structure, the microphone unit 110 and the unit board 112 are subjected to the compressive stress from the main board 120. The stress from the unit board 112 causes problems, such as difficulty in collecting low-pitched sound and generation of noise as described above in the microphone unit 110. The stress from the unit board 112 inhibits the electrical connection between the ground pattern 1220 of the main board 120 and the ground pattern 1210 of the unit board 112, resulting in generation of loud noise.

As described above, a compact condenser microphone barely produces high quality sound due to, for example, generation of noise.

A condenser microphone is disclosed that includes an electric circuit for electrically connecting the rear end of the unit casing to the circuit board via an inductor (See Japanese Patent No. 4,683,996, for example).

The condenser microphone disclosed in Japanese Patent No. 4,683,996 also barely produces high quality sound, due to the above problems.

SUMMARY OF INVENTION

An object of the present invention is to provide a compact microphone that can produce high quality sound.

The present invention provides a microphone including a microphone unit having a vibration plate that vibrates in response to sound, a unit board disposed rearward of the vibration plate, a first ground pattern disposed on the rear surface of the unit board, a unit casing accommodating the microphone unit and the unit board, a contact region of the unit casing, the contact region being in contact with the first ground pattern, a main board having a side face having a second ground pattern, the second ground pattern being in contact with the contact region, and an adhesive joining the side face of the main board to the microphone unit.

DESCRIPTION OF THE PREFERRED EMBODIMENTS

Microphone (1)

With reference to the drawings, the microphone of the present invention, especially an embodiment of a condenser microphone, will be described.

Figure 1:
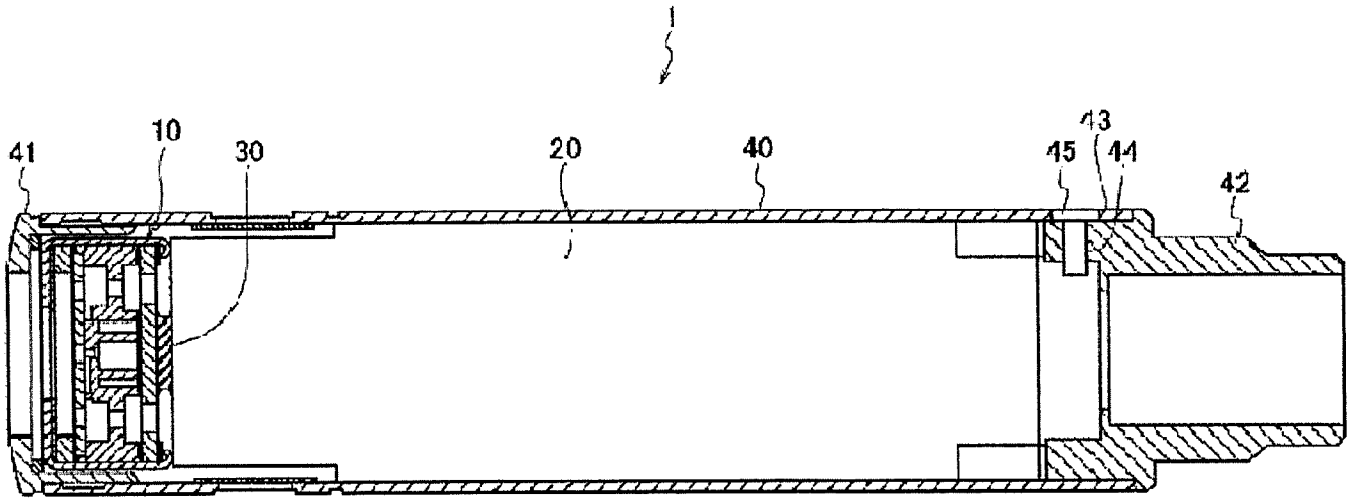
FIG. 1 is a sectional view illustrating an embodiment of the microphone according to the present invention.
Figure 2:
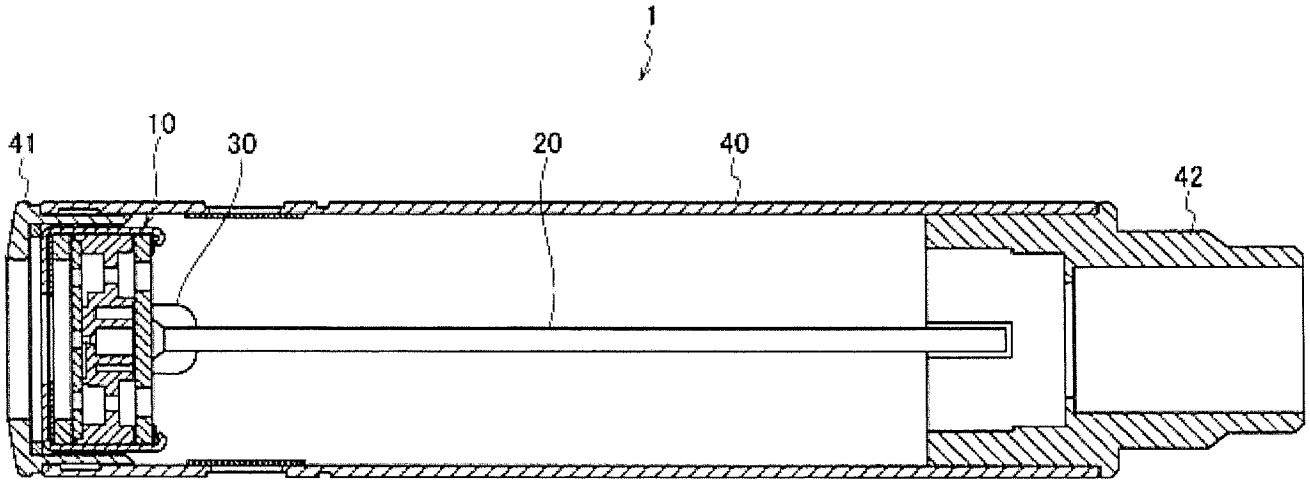
FIG. 2 is another sectional view illustrating the microphone of FIG. 1.

As shown in the sectional views of FIGS. 1 and 2, a microphone 1 of the present embodiment includes a microphone unit 10 having a vibration plate, and a main board 20 connected to the microphone unit 10. The microphone 1 also includes an adhesive 30 joining the microphone unit 10 to the main board 20, and a cylindrical microphone casing 40 accommodating the microphone unit 10 and the main board 20.

In the microphone 1, a side on which the microphone unit 10 is attached to the microphone casing 40 is referred to as the front side (the left in FIG. 1), and the opposite side (the right in FIG. 1) is referred to as the rear side.

Figure 3:
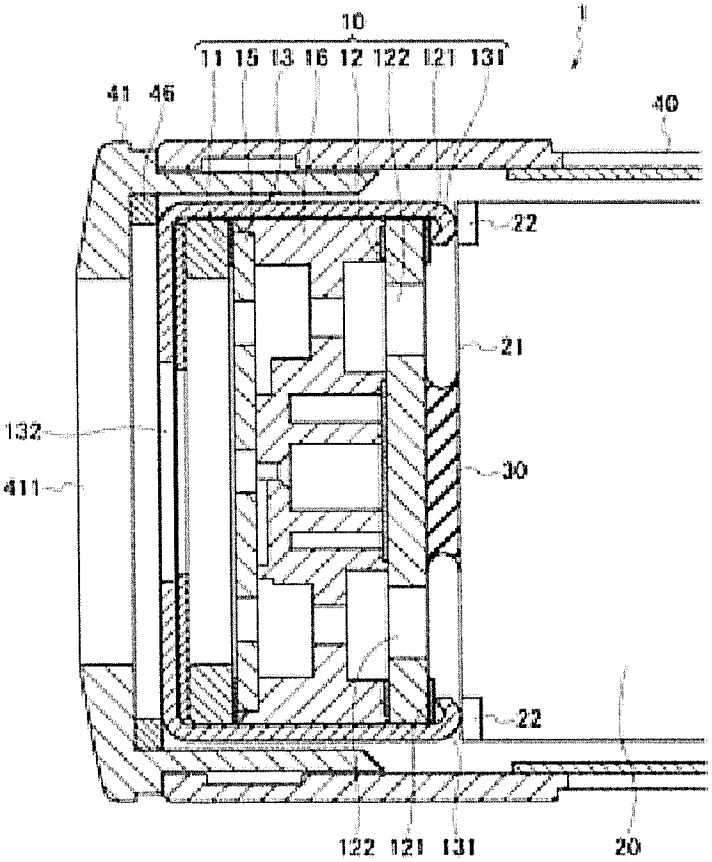
FIG. 3 is an enlarged sectional view illustrating a microphone unit of the microphone of FIG. 1.

As shown in FIG. 3, the microphone unit 10 is accommodated in the front space of the microphone casing 40. In the microphone casing 40, the main board 20 is joined to the rear end of the microphone unit 10 with the adhesive 30. The main board 20 has a second ground pattern 22 on a front end face 21, which is one of side faces of the main board 20. The second ground pattern 22 is in contact with a contact region 131 of a unit casing 13 of the microphone unit 10. A vibration plate 11, a fixed pole 15, an insulation base 16, and a unit board 12 are accommodated in the unit casing 13. The contact region 131, which has a hook shape, is formed by bending the open rear end portion of the unit casing 13. As shown in FIG. 3, a first ground pattern 121 is in contact with the tip end of the contact region 131. The second ground pattern 22 is in contact with the bent portion of the contact region 131. The adhesive 30 joins the unit board 12 to the main board 20 inside the contact region 131.

A front cover 41 covers the front open end of the cylindrical microphone casing 40. A tail piece 42 covers the rear open end of the cylindrical microphone casing 40. The tail piece 42 has a hole 44, and the microphone casing 40 has a hole 43. The microphone casing 40 and the tail piece 42 are fixed to each other with a screw 45 fastened into the holes 43 and 44.

FIG. 2 is a sectional view illustrating the microphone 1 of FIG. 1, as viewed from the direction perpendicular to the component mounting surface of the main board 20. That is, FIG. 2 is a sectional view illustrating the microphone 1 as viewed from a direction rotated 90° to the longitudinal axis of the microphone 1. As shown in FIG. 2, the main board 20 extends in the longitudinal direction of the microphone 1.

With reference to FIG. 3, the structure of the microphone unit 10 and the structure of the connection between the microphone unit 10 and the main board 20 will be described in more detail.

The microphone unit 10 is a condenser microphone unit, such as an electret condenser microphone unit. The microphone unit 10 includes the vibration plate 11 that vibrates in response to sound, and the fixed pole 15 disposed on the rear surface of the vibration plate 11. The microphone unit 10 also includes the unit board 12 having electronic components thereon, and the unit casing 13 accommodating the vibration plate 11, the fixed pole, and the unit board 12. The insulation base 16 is disposed between the fixed pole 15 and the unit board 12. The microphone unit 10 is in contact with the front cover 41 covering the front end of the microphone casing 40 via a spacer 46. The spacer 46 defines the position of the microphone unit 10 in the microphone casing 40.

The unit board 12 is disposed rearward of the vibration plate 11. The unit board 12 is an electronic circuit board, such as a printed board having a predetermined circuit pattern. The fixed pole 15 and electronic components are mounted on the front surface of the unit board 12. The unit board 12 has the first ground pattern 121. The first ground pattern 121 is formed on the rear surface of the unit board 12 accommodated in the unit casing 13, the rear surface being exposed to the outside and opposite the surface facing the vibration plate 11. The unit board 12 has through holes 122 extending between the front surface and the rear surface. The holes 122 communicate with a space rearward of the vibration plate 11 via holes provided in the insulation base 16 and the fixed pole 15. A rear acoustic terminal is disposed near the holes 122. The rear acoustic terminal is positioned at the center of the air mass that moves in response to the vibration of the vibration plate 11.

The unit casing 13 is a conductive housing accommodating the vibration plate 11 and the unit board 12 having electronic components thereon. The front portion of the unit casing 13 covers the front surface of the vibration plate 11, and the rear portion of the unit casing 13 is open. The unit casing 13 has substantially the same shape as the microphone 1, such as a cylindrical shape. The size of the unit casing 13 is determined in consideration of the sizes of the vibration plate 11 and the unit board 12, to prevent unwanted noise due to movement of the vibration plate 11 inside the unit casing.

The contact region 131, which is provided at the rear end of the unit casing 13, is in contact with the first ground pattern 121 of the unit board 12 accommodated in the unit casing 13. The contact region 131, which has a hook shape, is formed by bending the rear end portion of the unit casing 13 inward. In the front end surface of the unit casing 13, a hole 132 is provided for allowing sound signals to pass through an opening 411 in the front cover 41 of the microphone casing 40 to the vibration plate 11. A front acoustic terminal is disposed near the hole 132. The front acoustic terminal is positioned at the center of the air mass that moves in response to the vibration of the vibration plate 11.

The main board 20 is disposed rearward of the unit board 12 in the rear space of the unit casing 13. As in the unit board 12 described above, the main board 20 is an electronic circuit board, such as a printed board having a predetermined circuit pattern. In the main board 20, a circuit pattern is also formed on the front end face 21, which is one of side faces of the main board 20. The circuit pattern is the second ground pattern 22, which is in contact with the contact region 131. The length of the front end face 21 (the short side in FIG. 1) of the main board 20 having the second ground pattern 22 is almost equal to the diameter of the unit casing 13. The front end face 21 of the main board 20 only needs to have a length sufficient for the second ground pattern 22 to be contacted to the contact region 131 of the unit casing 13 so that the contact region 131 is electrically connected to the ground pattern 22. Therefore, the length of the front end face 21 is not necessarily equal to the diameter of the casing 13.

The adhesive 30 joins the front end face 21 of the main board 20 to the microphone unit 10. As shown in FIG. 3, the adhesive 30 joins the front end face 21 of the main board 20 to the rear surface of the unit board 12 accommodated in the unit casing 13. The adhesive 30 is preferably a rubber adhesive that has elasticity and is shrinkable through curing. The adhesive 30 joins the main board 20 to the unit board 12 inside the contact region 131, which is provided at the rear end of the unit casing 13.

In the microphone 1, the contact region 131 of the unit casing 13 is electrically connected to the first ground pattern 121 of the unit board 12 and the second ground pattern 22 of the main board 20. In addition, in the microphone 1, the main board 20 is joined to the unit casing 13 with the adhesive 30, which has elasticity and is shrinkable through curing. Thus, in the microphone 1, the cured adhesive 30 generates tensile stress between the unit board 12 and the main board 20, which maintains the electrical connection between the first ground pattern 121 and the second ground pattern 22.

Accordingly, the microphone 1 precludes generation of loud noise, which would occur due to the electrical disconnection between the first ground pattern 121 of the unit board 12 and the second ground pattern 22 of the main board 20. Thus, the microphone of the present embodiment produces high quality sound.

Figure 4:
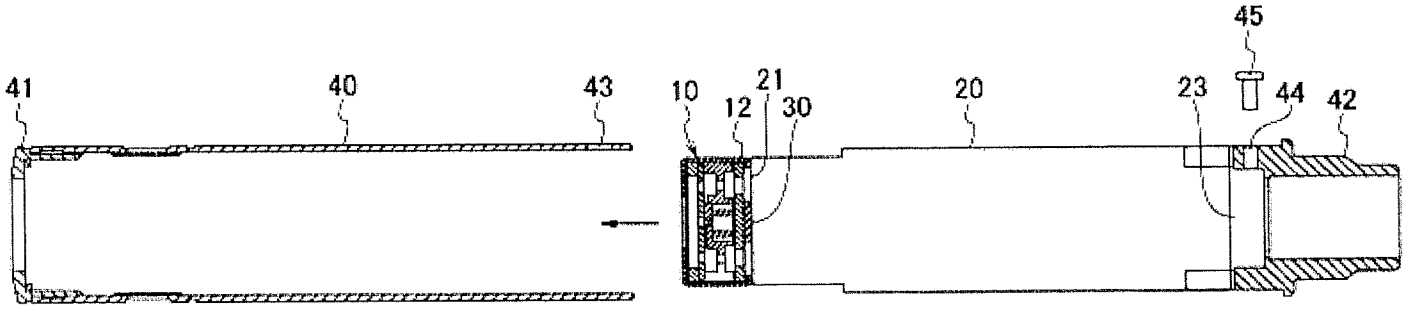
FIG. 4 is a sectional view illustrating a process of assembling the microphone of FIG. 1.

With reference to FIG. 4, the microphone 1 is assembled by the following process. The rear surface of the unit board 12 disposed in the rear portion of the microphone unit 10 is joined to the front end face 21 of the main board 20 with the adhesive 30. The microphone unit 10 and the main board 20 are then inserted in the microphone casing 40 having the front cover 41. Thereafter, the tail piece 42 is fitted into the microphone casing 40 to push a rear end face 23 of the main board 20. The tail piece 42 is fixed to the microphone casing 40 with the screw 45 fastened into the holes 43 and 44.

In the microphone 1 assembled by the above process, the first ground pattern 121 of the unit board 12 and the second ground pattern 22 of the main board 20 continue to be in electrical contact with the contact region 131 even under application of forward stress from the main board 20. The microphone 1 precludes generation of loud noise, and produces high quality sound.

In the microphone 1 assembled by the above process, the forward stress from the main board 20 is transmitted mainly to the microphone casing 40 but not to the unit board 12 or the vibration plate 11. The microphone 1 avoids problems due to a change in stress applied to the vibration plate 11, and produces high quality sound.

Microphone (2)

Another embodiment of the microphone of the present invention will be described only with reference to the differences from the above embodiment.

Figure 5:
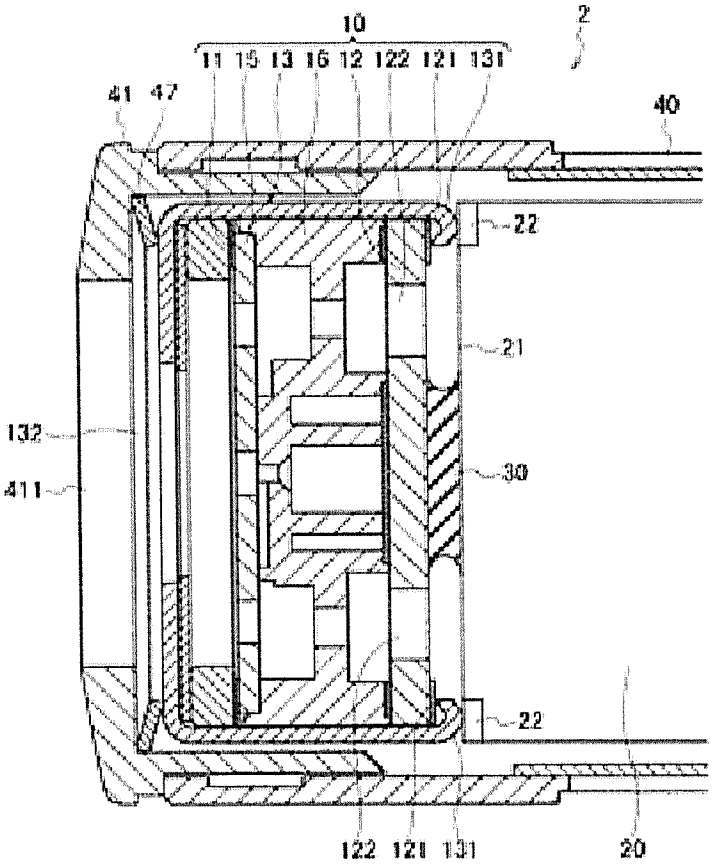
FIG. 5 is an enlarged sectional view illustrating a microphone unit of another embodiment of the microphone according to the present invention.
Figure 6:
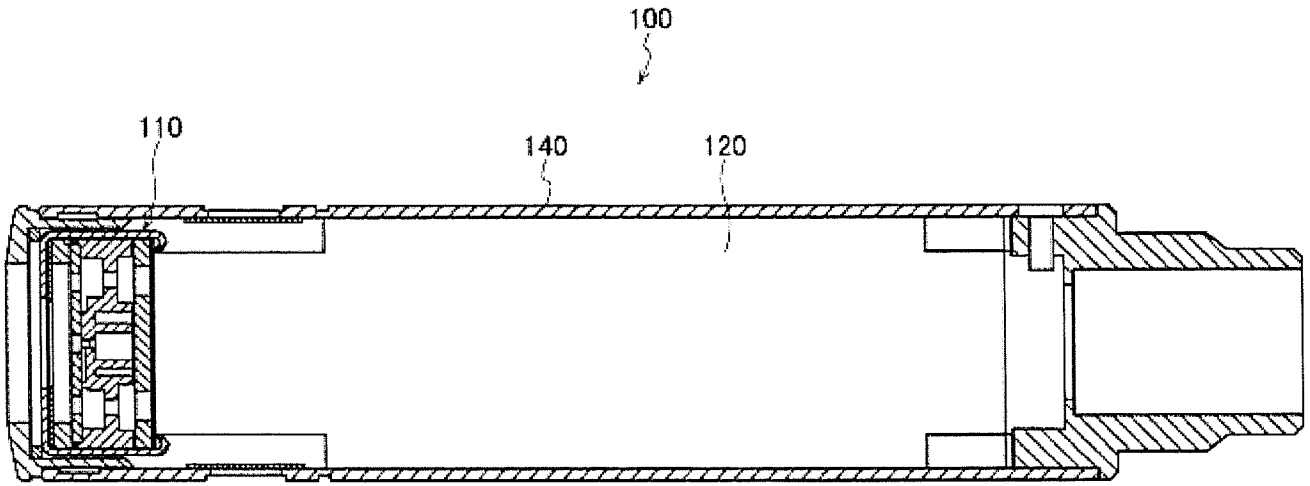
Fig.6 RELATED ART
FIG. 6 is a sectional view illustrating a conventional microphone.
Figure 7:
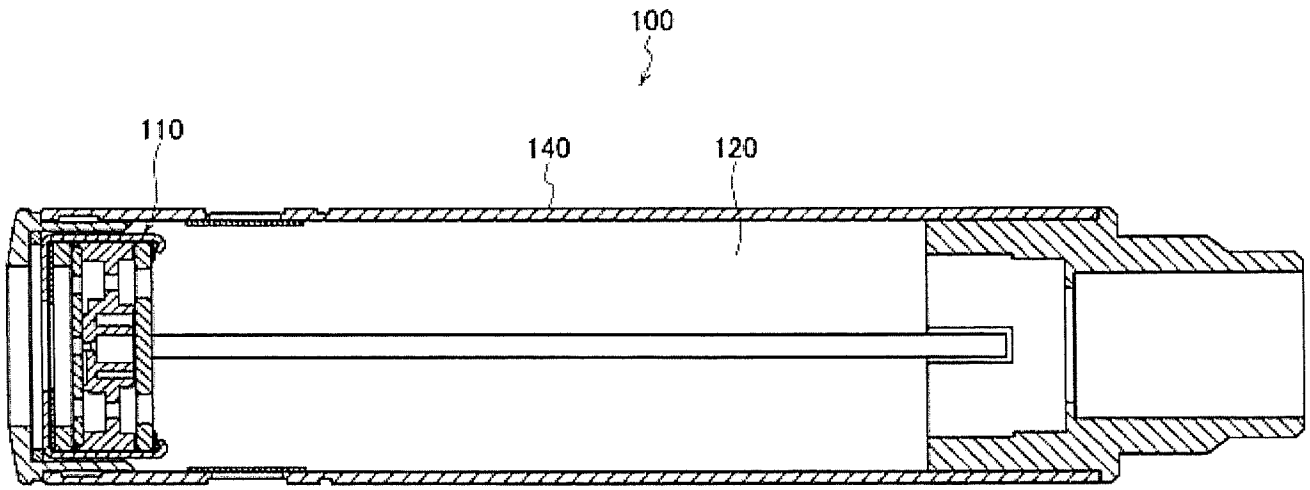
Fig. 7 RELATED ART
FIG. 7 is a sectional view illustrating the conventional microphone of FIG. 6, as viewed from the another direction (90 degrees in the rotation direction).
Figure 8:
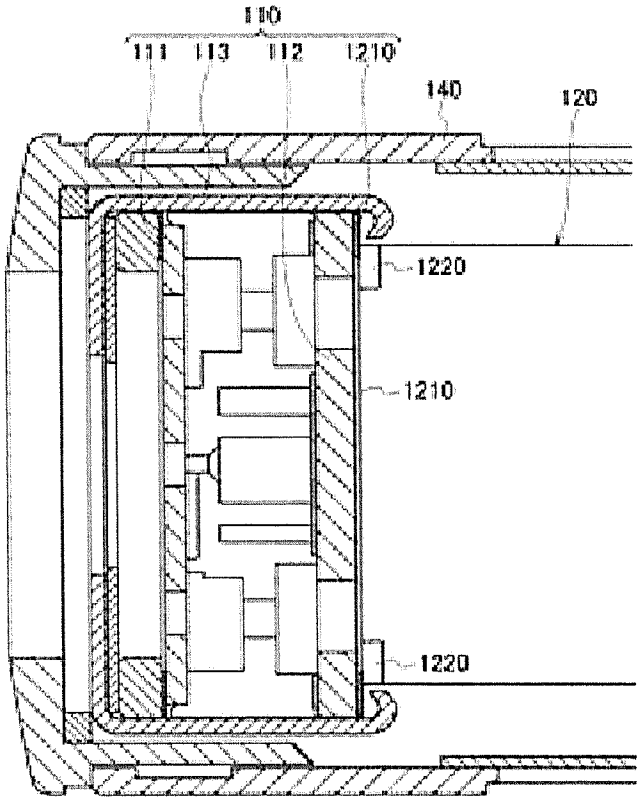
Fig.8 RELATED ART
FIG. 8 is an enlarged sectional view illustrating a microphone unit of the conventional microphone.
Figure 9:
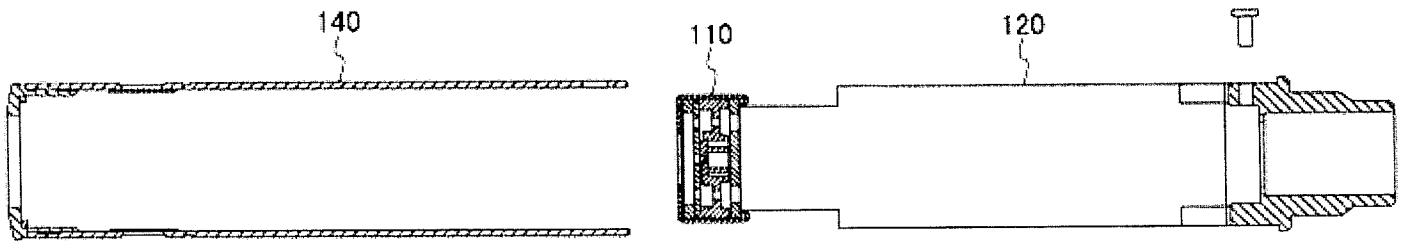
Fig. 9 RELATED ART
FIG. 9 is a sectional view illustrating a process of assembling the conventional microphone.

As shown in FIG. 5, the microphone 2 of the present embodiment includes a disc spring 47 as an elastic member disposed between the microphone unit 10 and the front cover 41 covering the front end of the microphone casing 40. The disc spring 47 defines the position of the microphone unit 10 in the microphone casing 40 and generates the force to push the microphone unit 10 rearward.

In the microphone 2, the disc spring 47 expands or contracts in response to the stress applied to the microphone unit 10. The microphone 2 reduces a change in stress transmitted to the vibration plate 11 to solve problems caused by the stress change, and produces high quality sound.

What is claimed is:

1. A microphone comprising:

a microphone unit including a vibration plate that vibrates in response to sound;

a unit board disposed rearward of the vibration plate;

a first ground pattern disposed on the rear surface of the unit board;

a unit casing accommodating the microphone unit and the unit board wherein the unit casing is open so as to expose the rear surface of the unit board;

a contact region of the unit casing, the contact region being in contact with the first ground pattern;

a main board having a side face having a second ground pattern, the second ground pattern being in contact with the contact region; and an adhesive joining the side face of the main board to the microphone unit, wherein the main board is joined with the adhesive to the rear surface of the unit board having the first ground pattern, and the main board and the unit board are separated by a gap and the adhesive is positioned in the gap, and wherein the adhesive has elasticity and is shrinkable through curing.

2. The microphone according to claim 1, wherein the adhesive is a rubber adhesive.

3. The microphone according to claim 1, wherein the side face of the main board having the second ground pattern has a length equal to the diameter of the unit casing.

4. The microphone according to claim 1, wherein the contact region comprises an inwardly bent portion at the rear end of the unit casing.

5. The microphone according to claim 4, wherein the first ground pattern is in contact with a tip end of the contact region and the second ground pattern is in contact with the bent portion of the contact region.

6. The microphone according to claim 4, wherein the adhesive joins the unit board to the main board inside the contact region.

7. The microphone according to claim 1, further comprising a housing accommodating the unit casing and the main board.

8. The microphone according to claim 7, further comprising a spacer disposed between the housing and the unit casing.

9. The microphone according to claim 8, wherein the spacer is an elastic member.

10. A microphone comprising:

a microphone unit including a vibration plate that vibrates in response to sound;

a unit board disposed rearward of the vibration plate;

a first ground pattern disposed on the rear surface of the unit board;

a unit casing accommodating the microphone unit and the unit board, wherein the unit casing is open so as to expose the rear surface of the unit board;

a contact region of the unit casing, the contact region being in contact with the first ground pattern;

a main board having a side face having a second ground pattern, the second ground pattern being in contact with the contact region; and an adhesive joining the side face of the main board to the microphone unit, wherein the main board is joined to the rear surface of the unit board having the first ground pattern with the adhesive; and wherein the adhesive has elasticity and is shrinkable through curing, and is configured to generate tensile stress between the unit board and the main board.

11. The microphone according to claim 10, wherein the tensile stress from the adhesive maintains an electrical connection between the first ground pattern and the second ground pattern.

12. The microphone according to claim 10, wherein the adhesive is a rubber adhesive.

13. The microphone according to claim 10, wherein the side face of the main board having the second ground pattern has a length equal to the diameter of the unit casing.

14. The microphone according to claim 10, wherein the contact region comprises an inwardly bent portion at the rear end of the unit casing.

15. The microphone according to claim 14, wherein the first ground pattern is in contact with a tip end of the contact region and the second ground pattern is in contact with the bent portion of the contact region.

16. The microphone according to claim 14, wherein the adhesive joins the unit board to the main board inside the contact region.

* * * * *